US010510211B2

(12) United States Patent
Morin

(10) Patent No.: US 10,510,211 B2
(45) Date of Patent: Dec. 17, 2019

(54) WAGERING GAME INCLUDING PROGRESSIVE GAME WITH UNKNOWN RANDOMLY GENERATED TRIGGER VALUE

(71) Applicant: Padrino Gaming Corp., Winnipeg (CA)

(72) Inventor: Kelvin Morin, Winnipeg (CA)

( * ) Notice: Subject to any disclaimer, the term of this patent is extended or adjusted under 35 U.S.C. 154(b) by 0 days.

(21) Appl. No.: 16/159,940

(22) Filed: Oct. 15, 2018

(65) Prior Publication Data

US 2019/0139361 A1 May 9, 2019

Related U.S. Application Data

(60) Provisional application No. 62/571,892, filed on Oct. 13, 2017.

(51) Int. Cl.
*G07F 17/32* (2006.01)

(52) U.S. Cl.
CPC ..... *G07F 17/3258* (2013.01); *G07F 17/323* (2013.01); *G07F 17/3209* (2013.01); *G07F 17/3211* (2013.01); *G07F 17/3225* (2013.01); *G07F 17/3293* (2013.01); *G07F 17/322* (2013.01)

(58) Field of Classification Search
USPC ..... 463/27
See application file for complete search history.

(56) References Cited

U.S. PATENT DOCUMENTS 9,208,637 B2 12/2015 Acres
9,355,521 B2 5/2016 King
9,626,807 B2 * 4/2017 Lyons ..... G07F 17/3211
9,633,512 B2 4/2017 Acres
9,704,339 B2 7/2017 Olive
2006/0178194 A1 8/2006 Jubinville et al.
2012/0004028 A1 1/2012 Guan et al.
2013/0281208 A1 * 10/2013 Lyons ..... G07F 17/3211 463/33
2013/0281209 A1 * 10/2013 Lyons ..... G07F 17/3211 463/33
2017/0193708 A1 * 7/2017 Lyons ..... G07F 17/3211
2018/0114397 A1 * 4/2018 Lyons ..... G07F 17/3204
2019/0043302 A1 * 2/2019 Lyons ..... G07F 17/3204

* cited by examiner

*Primary Examiner* — Pierre E Elisca

(74) *Attorney, Agent, or Firm* — Ryan W. Dupuis; Ade & Company Inc.; Kyle R. Satterthwaite

(57) ABSTRACT

A gaming system includes a game server operating a progressive game thereon and a plurality of player terminals in communication with the central server which operate base games thereon. A contribution amount from base wagers made on the player terminals in relation to the base game also contribute to one or more progressive totals of the progressive game. When one or more progressive totals reaches a secret trigger value, a winning condition is determined and a corresponding winning amount is made to the player terminal from which originated the contribution amount resulting in the secret trigger value being met. Optionally, under the winning condition, the progressive total may continue to increase by contribution amounts from one or more player terminals until eligibility criterium corresponding a second trigger event is met, such as a qualifying hand being dealt to the player terminal from which the winning condition originated.

20 Claims, 3 Drawing Sheets

| # of Stops | Pays |
|---|---|
| 6 Stops | 1 to 1 |
| 3 Stops | 2 to 1 |
| 1 Stops | 3 to 1 |
| 1 Stops | 4 to 1 |
| 1 Stops | 5 to 1 |

| # of Stops | Pays |
|---|---|
| 5 Stops | 1 to 1 |
| 2 Stops | 3 to 1 |
| 1 Stops | 5 to 1 |
| 1 Stops | 7 to 1 |
| 1 Stops | 9 to 1 |
| 1 Stops | 10 to 1 |
| 1 Stops | 30 to 1 |

WAGERING GAME INCLUDING PROGRESSIVE GAME WITH UNKNOWN RANDOMLY GENERATED TRIGGER VALUE

This application claims the benefit under 35 U.S.C. 119(e) of U.S. provisional application Ser. No. 62/571,892, filed Oct. 13, 2017.

FIELD OF THE INVENTION

The present invention relates to a wagering gaming system including a base game for accepting a wager on a base game betting position and a progressive game having a progressive total which increases by a contribution amount in response to a wager on the base game, in which the progressive total is paid out to the player when the progressive total reaches a randomly generated trigger value which is unknown to the player. The present invention further relates to a base game that includes auxiliary betting positions that pay out a winning amount according to a random selection between a plurality of different winning amounts.

BACKGROUND

In casino games, wagers (or "bets") are placed on the possible outcomes of a game, and a payout for the game may be based on the amount of the wager in addition to the odds of the wagered event occurring within the game or other event.

In addition to paying winning amounts on wagered events, various types of gaming systems further include a progressive jackpot amount that can be won when certain trigger conditions are met. Examples can be found in U.S. Pat. No. 9,208,637 by Acres; U.S. Pat. No. 9,355,521 by King; U.S. Pat. No. 9,633,512 by Acres; U.S. Pat. No. 9,704,339 by Olive; US 2006/0178194 by Jubinville et al; and US 2012/0004028 by Guan et al.

It is desirable to provide a gaming system with a progressive jackpot having unique trigger conditions that provide a new wagering experience for players, while enabling a suitable house advantage to be maintained for profitability of gaming provider.

Baccarat in particular is a popular wagering game which is desirable to be modified to provide players with an enhanced wagering experience. The game of Baccarat is defined in Wikipedia (https://en.wikipedia.org/wiki/Baccarat_(card game)) as follows:

"There are three popular variants of the game: punto banco (or "North American baccarat"), baccarat chemin de fer (or "chemmy"), and baccarat banque (or "à deux tableaux"). In Punto banco each player's moves are forced by the cards the player is dealt. In baccarat chemin de fer and baccarat banque, by contrast, both players can make choices. The winning odds are in favour of the bank, with a house edge no lower than around 1 percent.

Baccarat is a comparing card game played between two hands, the "player" and the "banker". Each baccarat coup (round of play) has three possible outcomes: "player" (player has the higher score), "banker", and "tie".

Valuation of Hands

In baccarat, cards have a point value: cards two through nine are worth face value (in points); tens, jacks, queens and kings have no point value (i.e. are worth zero); aces are worth 1 point; jokers are not used. Hands are valued according to the rightmost digit of the sum of their constituent cards. For example, a hand consisting of 2 and 3 is worth 5, but a hand consisting of 6 and 7 is worth 3 (i.e., the 3 being the rightmost digit in the combined points total of 13). The highest possible hand value in baccarat is therefore nine.

Punto Banco

The overwhelming majority of casino baccarat games in the United States, United Kingdom, Canada, Australia, Sweden, Finland, and Macau are "Punto banco" baccarat and they may be seen labelled simply as "Baccarat". About 91% of total income from Macau casinos in 2014 came from punto banco. In Punto banco, the casino banks the game at all times, and commits to playing out both hands according to fixed drawing rules, known as the "tableau" (French: "board"), in contrast to more historic baccarat games where each hand is associated with an individual who makes drawing choices. Player ("Punto") and Banker ("banco") are simply designations for the two hands dealt out in each coup, two outcomes which the bettor can back; Player has no particular association with the gambler, nor Banker with the house.

In some countries, this version of the game is known as tableau.

Punto banco is dealt from a shoe containing 6 or 8 decks of cards shuffled together with 8 decks being most commonly used. A cut-card—a coloured (often yellow) piece of plastic, the same size as a regular card, and which is used in shuffling—is placed in front of the seventh-last card, and the drawing of the cut-card indicates the last coup of the shoe. For each coup, two cards are dealt face up (or equivalent) to each hand, starting from "player" and alternating between the hands. The croupier may call the total (e.g. "Five Player, three Banker"). If either Player or Banker or both achieve a total of 8 or 9 at this stage, the coup is finished and the result is announced: Player win, a Banker win, or tie. If neither hand has eight or nine, the drawing rules are applied to determine whether Player should receive a third card. Then, based on the value of any card drawn to the player, the drawing rules are applied to determine whether the Banker should receive a third card. The coup is then finished, the outcome is announced, and winning bets are paid out.

Tableau of Drawing Rules

If neither the Player nor Banker is dealt a total of 8 or 9 in the first two cards (known as a "natural"), the tableau is consulted, first for Player's rule, then Banker's.

Player's Rule

If Player has an initial total of 0-5, he draws a third card. If Player has an initial total of 6 or 7, he stands.

Banker's Rule

If Player stood pat (i.e., has only two cards), the banker regards only his own hand and acts according to the same rule as Player. That means Banker draws a third card with hands 0-5 and stands with 6 or 7.

If Player drew a third card, the Banker acts according to the following more complex rules:

If Player drew a 2 or 3, Banker draws with 0-4 and stands with 5-7.

If Player drew a 4 or 5, Banker draws with 0-5 and stands with 6-7.

If Player drew a 6 or 7, Banker draws with 0-6 and stands with 7.

If Player drew an 8, Banker draws with 0-2 and stands with 3-7.

If Player drew an ace, 9, 10, or face-card, the Banker draws with 0-3 and stands with 4-7.

The casinos list these rules in a more easily remembered format as follows:

If the banker total is 2 or less, then the banker draws a card, regardless of what the player's third card is.

If the banker total is 3, then the bank draws a third card unless the player's third card was an 8.

If the banker total is 4, then the bank draws a third card if the player's third card was 2, 3, 4, 5, 6, 7.

If the banker total is 5, then the bank draws a third card if the player's third card was 4, 5, 6, or 7.

If the banker total is 6, then the bank draws a third card if the player's third card was a 6 or 7.

If the banker total is 7, then the banker stands.

A math formula equivalent to the drawing rules is: take the value of Player's third card, counting 8 and 9 as −2 and −1. Divide by 2 always rounding towards zero. (Thus −1, 0, and 1 all round to zero when this division is done.) Add three to the result. If the Banker's current total is this final value or less, then draw; otherwise, stand.

The croupier will deal the cards according to the tableau and the croupier will announce the winning hand: either Player or Banker. Losing bets will be collected and the winning bets will be paid according to the rules of the house. Usually, even money or 1-to-1 will be paid on Player bets and 95% or 19-to-20 on Banker bets (even money with "5% commission to the house on the win").

Should both Banker and Player have the same value at the end of the deal the croupier shall announce "égalité—tie bets win." All tie bets will be paid at 8-to-1 odds and all bets on Player or Banker remain in place and active for the next game (the customer may or may not be able to retract these bets depending on casino rules). House edge details (8 decks)

| | |
|---|---|
| If Banco wins | 1.06% |
| If Punto wins | 1.24% |
| If ties (8-to-1 payout) | 14.4% |
| If ties (9-to-1 payout) | 4.85% |

Casino Provision

In casinos in Las Vegas and Atlantic City, punto banco is usually played in special rooms separated from the main gaming floor, ostensibly to provide an extra measure of privacy and security because of the high stakes often involved. The game is frequented by very high rollers, who may wager tens or hundreds of thousands of dollars on a single hand. Minimum bets are relatively high, often starting at $100 and going as high as $500. Posted maximum bets are often arranged to suit a player. When it comes to online casinos, usually high roller baccarat games are played in separate rooms. A player that wants to play high roller baccarat online can do so only with an invitation which is not easily acquired. Most of the time the invitations are given to players who spend a significant amount of time playing baccarat for real money.

Because baccarat attracts wealthy players, a casino may win or lose millions of dollars a night on the game, and the house's fortunes may significantly affect the owning corporation's quarterly profit and loss statement. Notations of the effects of major baccarat wins and losses are frequently found in the quarterly reports of publicly traded gaming companies.

The full-scale version of punto banco baccarat is played at a large rounded table, similar to chemin de fer. The table is staffed by a croupier, who directs the play of the game, and two dealers who calculate tax and collect and pay bets. Six or eight decks of cards are used, normally shuffled only by the croupier and dealers. The shoe is held by one of the players, who deals the cards on the instructions of the croupier according to the tableau. On a Player win, the shoe moves either to the highest winning bettor, or to the next person in clockwise order around the table, depending on the casino's conventions. The shoe may be refused or the croupier may be requested to deal. In smaller and lower-stakes games, the cards are often handled exclusively by casino staff.

Dealing

The dealer burns the first card face up and then based on its respective numerical value, with aces worth 1 and face cards worth 10, the dealer burns that many cards face down. The dealer deals one card at a time to player first and based on casino rules reveals one card at a time or both cards at the same time.

Punto Banco Odds and Strategy

Punto banco has both some of the lowest house edges among casino table games, and some of the highest. The Player bet has an attractively low house edge of 1.24%, and the Banker bet (despite the 5% commission on the win) is even lower, at 1.06%. Both are just slightly better for Player than chances at single-zero roulette, and comparable to playing blackjack by intuition[further explanation needed] rather than correct strategy.

In contrast, the tie bet which pays 8-to-1 has a high house edge of 14.4%. Most casinos in the United Kingdom pay the tie at 9-to-1, resulting in a more lenient house edge of approximately 4.85%.

Despite having a low house edge, punto banco is not susceptible to advantage play, and despite the superficial similarities to blackjack, card counting is not profitable. In his 1984 analysis (Thorp 1984), Thorp concludes that: Advantages in baccarat are very small, they are very rare and the few that occur are nearly always in the last five to 20 cards in the pack.—(Thorp 1984), p. 38

Nonetheless, many punto banco players record the coup results as the shoe progresses, laying them out using pen and paper according to traditional patterns such as "big road", "bead road", "big eye road", "small road" and "cockroach road", and making inferences about the result of the next coup by examining the layout. Recently casinos (particularly online casinos) have begun to display the coup results in the current shoe using audiovisual equipment.

Super 6/Punto 2000

A variation of punto banco exists where even money is paid on winning Banker bets (rather than 95%), except when Banker wins with 6, it is paid only 50% of the bet. This game goes under various names including Super 6 and Punto 2000. The house edge on a Banker bet under Super 6 is 1.46% compared with regular commission baccarat at 1.058%. This is equivalent to increasing the commission by 17.45% to 5.87%. The Bank wins with a six about 5 times every eight deck shoe. As well as its increased house edge, the Super 6 variation is used by casinos for its speed, since it partially does away with the time-consuming process of calculating and collecting commission on winning Banker bets; but still requires stopping the game, breaking down every Bank bet, and paying 50% of its value each time there is a Bank winner with a six.

EZ Baccarat

A variation of punto banco originating in 2004 where even money is paid on winning Banker, except when Banker wins with a total of 7 after the third card is drawn, instead the Banker pushes if it wins. The game has two additional options, the Dragon 7 which pays 40-to-1 and the Panda 8 which pays 25-to-1. House edge when betting on Banker is reduced to 1.02% instead of 1.06% in standard punto banco.[15]

Dragon 7

A bet on the Banker to total 7 points with three cards drawn. Pays 40-to-1 leaving a 7.61% house edge.

Panda 8

A bet on the Player to total 8 points with three cards drawn. Pays 25-to-1 leaving a 10.19% house edge.

House Edge Details (8 Decks)

| | |
|---|---|
| If Banco wins | 1.02% |
| If Punto wins | 1.24% |
| If ties (8-to-1 payout) | 14.4% |

Chemin De Fer

Chemin de Fer, which first appeared in the late 19th century, was so called because it was quicker than the original game,[16] the railway (in French, "chemin de fer") being at that time the fastest means of transport. It is still the most popular version in France.

Six decks of cards are used, shuffled together. Players are seated in random order, typically around an oval table; discarded cards go to the center. Play begins to the right of the croupier and continues counter-clockwise. At the start of the game, the croupier and then all players shuffle the cards in play order. The croupier shuffles a final time and the player to his left cuts the deck.

Once play begins, one player is designated as the "banker". This player also deals. The other players are "punters". The position of banker passes counter-clockwise in the course of the game. In each round, the banker wagers the amount he wants to risk. The other players, in order, then declare whether they will "go bank", playing against the entire current bank with a matching wager. Only one player may "go bank". If no one "goes bank", players make their wagers in order. If the total wagers from the players are less than the bank, observing bystanders may also wager up to the amount of the bank. If the total wagers from the players are greater than the bank, the banker may choose to increase the bank to match; if he does not, the excess wagers are removed in reverse play order.

The banker deals four cards face down: two to himself and two held in common by the remaining players. The player with the highest individual wager (or first in play order if tied for highest wager) is selected to represent the group of non-banker players. The banker and player both look at their cards; if either has an eight or a nine, this is immediately announced and the hands are turned face-up and compared. If neither hand is an eight or nine, the player has a choice to accept or refuse a third card; if accepted, it is dealt face-up. Traditional practice—grounded in mathematics, similar to basic strategy in blackjack, but further enforced via social sanctions by the other individuals whose money is at stake—dictates that one always accept a card if one's hand totals between 0 and 4, inclusive, and always refuse a card if one's hand totals 6 or 7. After the player makes his decision, the banker in turn decides either to accept or to refuse another card. Once both the banker and the representative player have made their decision, the hands are turned face-up and compared.

If the player's hand exceeds the banker's hand when they are compared, each wagering player receives back their wager and a matching amount from the bank, and the position of banker passes to the next player in order. If the banker's hand exceeds the player's hand, all wagers are forfeit and placed into the bank, and the banker position does not change. If there is a tie, wagers remain as they are for the next hand.

If the banker wishes to withdraw, the new banker is the first player in order willing to stake an amount equal to the current bank total. If no one is willing to stake this amount, the new banker is instead the next player in order, and the bank resets to whatever that player wishes to stake. Many games have a set minimum bank or wager amount.

In 1960 Lord Lucan won £26,000 ($76,769) over two nights playing chemin de fer ata high-end gambling party run by John Aspinall. However, Lucan would eventually accrue significant debts.

Baccarat Banque

In Baccarat Chemin de Fer, a given bank only continues so long as the banker wins. As soon as he loses, it passes to another player. In Baccarat Banque the position of banker is much more permanent. Three packs of cards are shuffled together. (The number is not absolute, sometimes four packs, sometimes two only, being used; but three is the more usual number.)[citation needed]The banker (unless he retires either of his own free will or by reason of the exhaustion of his finances) holds office until all these cards have been dealt.

The bank is at the outset put up to auction, i.e. belongs to the player who will undertake to risk the largest amount. In some circles, the person who has first set down his name on the list of players has the right to hold the first bank, risking such amount as he may think proper.

The right to begin having been ascertained, the banker takes his place midway down one of the sides of an oval table, the croupier facing him, with the waste-basket between. On either side of the banker are the punters (ten such constituting a full table). Any other persons desiring to take part remain standing, and can only play in the event of the amount in the bank for the time being not being covered by the seated players.

The croupier, having shuffled the cards, hands them for the same purpose to the players to the right and left of him, the banker being entitled to shuffle them last, and to select the person by whom they shall be cut. Each punter having made his stake, the banker deals three cards, the first to the player on his right, the second to the player on his left, and the third to himself; then three more in like manner. The five punters on the right (and any bystanders staking with them) win or lose by the cards dealt to that side; the five others by the cards dealt to the left side. The rules as to turning up with eight or nine, offering and accepting cards, and so on, are the same as at Baccarat Chemin de Fer.

Each punter continues to hold the cards for his side so long as he wins or ties. If he loses, the next hand is dealt to the player next following him in rotation.

Any player may "go bank", the first claim to do so belonging to the punter immediately on the right of the banker; the next to the player on his left, and so on alternatively in regular order. If two players on opposite sides desire to "go bank", they go half shares.

A player going bank may either do so on a single hand, in the ordinary course, or a cheval, i.e. on two hands separately, one-half of the stake being played upon each hand. A player going bank and losing may again go bank, and if he again loses, may go bank a third time, but not further.

A player undertaking to hold the bank must play out one hand, but may retire at any time afterwards. On retiring, he is bound to state the amount with which he retires. It is then open to any other player (in order of rotation) to continue the bank, starting with the same amount, and dealing from the remainder of the pack, used by his predecessor. The outgoing banker takes the place previously occupied by his successor.

The breaking of the bank does not deprive the banker of the right to continue, provided that he has funds with which to replenish it, up to the agreed minimum.

Should the stakes of the punters exceed the amount for the time being in the bank, the banker is not responsible for the amount of such excess. In the event of his losing, the croupier pays the punters in order of rotation, so far as the funds in the bank will extend; beyond this, they have no claim. The banker may, however, in such a case, instead of resting on his right, declare the stakes accepted, forthwith putting up the needful funds to meet them. In such event the bank thenceforth becomes unlimited, and the banker must hold all stakes (to whatever amount) offered on any subsequent hand, or give up the bank.

In the laws of baccarat, no one code is accepted as authoritative. Different clubs make their own rules."

SUMMARY OF THE INVENTION

According to one aspect of the invention there is provided a gaming system for playing a wagering game, the system comprising:

a gaming server including a memory storing gaming software thereon, a processor, and a random number generator;

a gaming display associated with the gaming server to display gaming information thereon to a player of the wagering game;

a player input device associated with the gaming server to receive player input from the player of the wagering game in response to gaming information displayed on the gaming display;

the gaming software stored on the memory of the gaming server defining base game rules relating to a base game of the wagering game comprised of a plurality of betting options and progressive game rules relating to a progressive game of the wagering game, the progressive game including a minimum progressive amount, a maximum progressive amount, a trigger value that is between the minimum and maximum progressive amounts, and a progressive total stored in the memory;

the processor of the gaming server being arranged to execute the gaming software thereon in response to the player input received by the player input device to:

(i) identify a base game wager from the player relating to the base game;

(ii) augment the progressive total by a prescribed contribution amount based on the base game wager in response to the base game wager from the player being identified;

(iii) credit the player a winning amount corresponding to the progressive total in response to the progressive total being augmented by the prescribed contribution amount to an amount which meets or exceeds the trigger value;

(iv) in response to crediting the player a winning amount, use the random number generator to generate a new value for the trigger value which is between the minimum and maximum progressive amounts;

(v) in response to crediting the player a winning amount, reset the progressive total;

(vi) store the new value as the trigger value in a manner that the trigger value is not displayed or otherwise known to the player; and (vii) repeat steps (i) through (vi).

The processor is preferably arranged to execute the gaming software such that the progressive total is reset to the minimum progressive amount in response to crediting the player the winning amount.

The gaming system may further comprise a plurality of player terminals for a plurality of players respectively, each player terminal comprising a gaming display to display gaming information to the respective player and a player input device to receive player input from the player of the wagering game, wherein the processor of the gaming server is arranged to execute the gaming software thereon in response to the player input received by each player input device to augment the progressive total by a prescribed contribution amount based on the base game wager in response to the base game wager being received from each of the player.

The gaming system may further comprise a plurality of player terminals for a plurality of players respectively in which each player terminal comprises a gaming display to display gaming information to the respective player, a player input device to receive player input from the player of the wagering game, and a progressive game associated with each of the player terminals respectively, wherein the processor of the gaming server is arranged to execute the gaming software thereon in response to the player input received by each player input device to augment only the associated progressive total by a prescribed contribution amount based on the base game wager in response to the base game wager being received from the associated player.

The gaming display may display a current value of the progressive total.

The prescribed contribution amount may be a fixed portion of every winning and losing wager, a fixed portion of losing wagers only, a fixed portion of winning wagers only, or a fixed portion of selected ones of the plurality of betting options only. The fixed portion may be a fixed dollar amount or a fixed percentage amount of the wager.

Alternatively, the prescribed contribution amount may be a random portion of the wager.

In a preferred embodiment, the base game rules define a conventional baccarat game.

Preferably the trigger value remains constant between occasions where the player is credited a winning amount; however, in some instance, the trigger value may be a dynamic value which is reset in some instances when the progressive total does not meet or exceed to the trigger value.

According to a second aspect of the present invention there is provided a gaming system for playing a wagering game, the system comprising:

a gaming server including a memory storing gaming software thereon, a processor, and a random number generator;

a gaming display associated with the gaming server to display gaming information thereon to a player of the wagering game;

a player input device associated with the gaming server to receive player input from the player of the wagering game in response to gaming information displayed on the gaming display;

the gaming software stored on the memory of the gaming server defining base game rules relating to a base game of the wagering game comprised of a plurality of betting options and progressive game rules relating to a plurality of progressive games of the wagering game, each progressive game including a minimum progressive amount, a maximum progressive amount, a trigger value that is between the minimum and maximum progressive amounts, a progressive total, and an eligibility criterium stored in the memory;

the processor of the gaming server being arranged to execute the gaming software thereon in response to the player input received by the player input device to:

(i) identify a base game wager from the player relating to the base game;

(ii) augment the progressive total of each progressive game by a prescribed contribution amount based upon the base game wager in response to the base game wager from the player being identified;

(iii) credit the player a winning amount corresponding to the progressive total of one of the progressive games in response to the eligibility criterium of that progressive game being met and the progressive total being augmented by the prescribed contribution amount to an amount which meets or exceeds the trigger value of that progressive game;

(iv) in response to crediting the player a winning amount corresponding to the progressive total of one of the progressive games, use the random number generator to generate a new value for the trigger value for that progressive game which is between the minimum and maximum progressive amounts of that progressive game;

(v) store the new value as the trigger value for that progressive game in a manner that the trigger value is not displayed or otherwise known to the player; and (vi) repeat steps (i) through (v).

Preferably each trigger value is a unique value which differs from the trigger values of other progressive games.

Preferably, when each eligibility criterium has a probability of occurrence, the prescribed contribution amounts of the progressive games are proportional to probability of occurrences of the progressive games respectively.

The processor of the gaming server may be arranged to execute the gaming software thereon to send an alert through the gaming display when the progressive total has been augmented by the prescribed contribution amount to an amount which meets or exceeds the trigger value of that progressive game, but the eligibility criterium of that progressive game has not yet been met.

According to another aspect of the present invention there is provided a gaming system for playing a wagering game, the system comprising:

a gaming server including a memory storing gaming software thereon and a processor;

a gaming display associated with the gaming server to display gaming information thereon to a player of the wagering game;

a plurality of player input devices associated with the gaming server to receive player input from respective players of the wagering game in response to gaming information displayed on the gaming display;

the gaming software stored on the memory of the gaming server defining (i) a random number generator, (ii) base game rules relating to a base game of the wagering game associated with each player input device comprised of a plurality of betting options, and (iii) progressive game rules relating to at least one progressive game of the wagering game, said at least one progressive game including a minimum progressive amount, a maximum progressive amount, a trigger value that is between the minimum and maximum progressive amounts, a progressive total, and an eligibility criterium stored in the memory;

the processor of the gaming server being arranged to execute the gaming software thereon in response to the player input received by the player input device to execute a round of play by:

(i) identifying and resolving a base game wager input from the player on each player input device relating to the base game;

(ii) augmenting the progressive total of said at least one progressive game by a prescribed contribution amount based upon the base game wager on each player input device;

(iii) in response to the progressive total being augmented by the prescribed contribution amount to an amount which meets or exceeds the trigger value of that progressive game, determining that the player input device from which said prescribed contribution amount originated is in a winning state;

(iv) if the eligibility criterium of that progressive game is not met and the player terminal is in the winning state, maintaining that player input device in the winning state for a subsequent round of play;

(v) if eligibility criterium of that progressive game is met and that player input device is in the winning state, credit the player input device a winning amount corresponding to the progressive total of that progressive game and use the random number generator to generate a new value for the trigger value for that progressive game which is between the minimum and maximum progressive amounts of that progressive game and store the new value as the trigger value for that progressive game in a manner that the trigger value is not displayed or otherwise known to the players operating the player input devices; and (vi) repeat steps (i) through (v).

According to another aspect of the present invention there is provided a gaming system for playing a wagering game, the system comprising:

a gaming server including a server memory and a gaming processor;

a plurality of player terminals in communication with the gaming server for use by respective players of the game, each player terminal comprising a terminal memory, a terminal processor, a terminal display to display gaming information thereon to the respective player and a terminal input device adapted to receive player input from the player of the wagering game in response to gaming information displayed on the terminal display;

gaming programming instructions stored on one or both of the memory of the gaming server and the memories of the player terminals defining (i) a random number generator, (ii) base game rules relating to a base game of the wagering game comprised of a plurality of betting options and (iii) progressive game rules relating to at least one progressive game of the wagering game;

said at least one progressive game including a minimum progressive amount, a maximum progressive amount, a trigger value that is between the minimum and maximum progressive amounts, a progressive total, and an eligibility criterium stored on one or both of the memory of the gaming server and the memories of the player terminals;

the processors of the gaming server and the player terminals being arranged to execute the gaming programming instructions thereon in response to the player input received by the terminal input device of each player terminal to execute a round of play by:

(i) identifying and resolving a base game wager input from the player relating to the base game;

(ii) augmenting the progressive total of said at least one progressive game by a prescribed contribution amount based upon the base game wager;

(iii) in response to the progressive total being augmented by the prescribed contribution amount to an amount which meets or exceeds the trigger value of that progressive game, determining that the player terminal from which said prescribed contribution amount originated is in a winning state;

(iv) if the eligibility criterium of that progressive game is not met and the player terminal is in the winning state, maintaining that player terminal in the winning state for a subsequent round of play;

(v) if eligibility criterium of that progressive game is met and that terminal is in the winning state, credit the player a winning amount corresponding to the progressive total of that progressive game and use the random number generator to generate a new value for the trigger value for that progressive game which is between the minimum and maximum progressive amounts of that progressive game and store the new value as the trigger value for that progressive game in a manner that the trigger value is not displayed or otherwise known to the player; and (vii) repeat steps (i) through (vi).

Preferably the processors of the gaming server and the player terminals are arranged to execute the gaming programming instructions thereon such that the winning amount is only credited to the player terminal from which originated said prescribed contribution amount that augmented the progressive total to the amount which meets or exceeds the trigger value.

Preferably the processors of the gaming server and the player terminals are arranged to execute the gaming programming instructions thereon such that, in the winning state, the progressive total continues to augment by contribution amounts from all player terminals until the eligibility criterium is met on the player terminal from which originated said prescribed contribution amount that augmented the progressive total to the amount which meets or exceeds the trigger value.

Preferably the processors of the gaming server and the player terminals are arranged to execute the gaming programming instructions thereon such that the gaming server provides an indication to all player terminals that one of the player terminals is in the winning state without identifying which of the player terminals is in the winning state in response to determination of the winning state on said one of the player terminals and such that the gaming server continues to provide said indication until the eligibility criterium is met on the player terminal from which originated said prescribed contribution amount that augmented the progressive total to the amount which meets or exceeds the trigger value.

According to a further aspect of the present invention there is provided a gaming system for playing a wagering game, the system comprising:

a gaming server including a memory storing gaming software thereon, a processor, and a random number generator;

a gaming display associated with the gaming server to display gaming information thereon to a player of the wagering game;

a player input device associated with the gaming server to receive player input from the player of the wagering game in response to gaming information displayed on the gaming display;

the gaming software stored on the memory of the gaming server defining game rules of the wagering game comprised of:

(i) a plurality of betting options defining base game criteria relating to a conventional base game and auxiliary game criteria differing from the conventional base game;

(ii) a base game winning amount associated with each of the base game criteria; and (iii) a plurality of auxiliary winning amounts associated with each of the auxiliary game criteria;

the processor of the gaming server being arranged to execute the gaming software thereon in response to the player input received by the player input device to:

(i) identify a game wager from the player relating to one of the betting options among the game rules;

(ii) determine an outcome of the betting options when a round of play of the wagering game is executed;

(iii) supplementary to crediting the player the base game winning amount associated with said one of the base game criteria when the outcome of the betting options meets one of the base game criteria, in response to the outcome of the betting options meeting one of the auxiliary game criteria using the random number generator to select one of the auxiliary winning amounts associated with said one of the auxiliary game criteria; and (iv) credit the player the selected one of the auxiliary winning amounts.

The gaming software preferably includes different probability values associated with each auxiliary winning amount and the processor of the gaming server is preferably arranged to execute the gaming software thereon to select one of the auxiliary winning amounts using the random number generator and the different probability values.

According to one preferred embodiment, the base game criteria relates to a conventional baccarat game.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
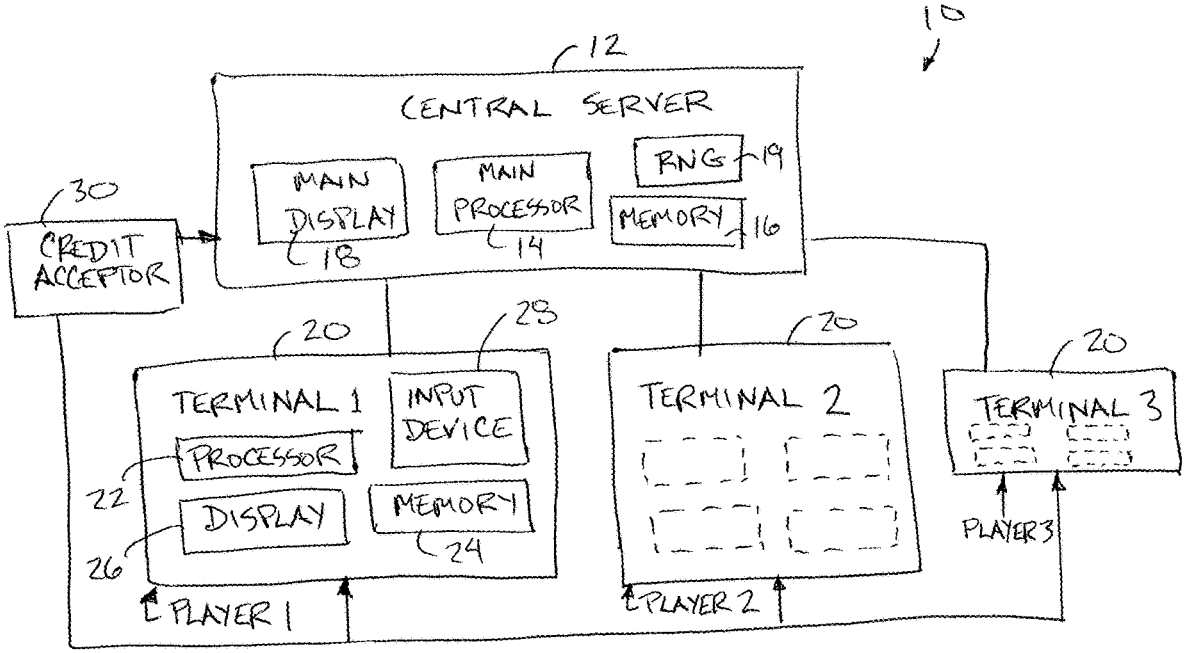
FIG. 1 is a schematic representation of the gaming system according to various embodiments of the present invention.

Referring to the accompanying figures there is illustrated a gaming system generally indicated by reference numeral 10 which can be used by players for playing a wagering game.

Turning initially to FIG. 1, in a typical embodiment of the gaming system 10, a central server 12 is provided which includes a main processor 14, a memory 16 storing programming thereon for execution by the processor, and a main display 18 for communicating information to the users of the system. The central server typically includes a random number generator 19 used for producing random number output that is used in execution of the game and determination of various outcomes of the game.

In some instances, each player is associated with a respective player terminal 20 which also includes a respective processor 22 for executing programming stored on a respective memory 24 and for displaying information on a respective terminal display 26. A player input device 28 is associated with each player terminal 20.

A credit acceptor 30 is associated with the system for accepting credits from the players in which the credit acceptor may be configured to communicate credits directly to the central server or to individual player terminals.

The overall system described above thus effectively defines a gaming server comprised of one or more computers which may include the central server as a single computer or a distributed network with or without the individual computers of player terminals which communicate with the main computer of the central server to define the overall gaming server. The collective displays of the terminal units and the central server also defined an overall gaming display for displaying information to the respective players of the game. Gaming software as defined herein includes software stored on the memory of one or both of the central server and the player terminals for executing the rules of the various games as defined in the following.

One aspect of the present invention relates to a wagering gaming system referred to herein as 99 Mysteries Baccarat. 99 Mysteries Baccarat is a modified version of baccarat where there is no standard 5% commission paid on winning Banker hands. According to one modified version of the game, the conventional Baccarat rules are supplemented by a multi-level mystery bonus prize to any wager made and requires no additional wagers from the players (self-funded).

The concept is intended to be played on a method of baccarat play where a mechanism is in place that can determine the amounts wagered by each player and subsequently each wager that each player makes on the specific betting options that contributes to the mystery prize(s) OR a where a mechanism is in place that can determine how many individual wagers were made so that the posted minimum bet results in enough wagers to cover the expense of the mystery prize(s).

For example, there are technologies that are capable of capturing betting information, such as electronic betting terminals wagering on live outcomes, virtual games that replicate card games and live games that incorporate RFID or digital video technologies that identify wager amounts. However, this method is not restricted to those technologies.

Figure 3:
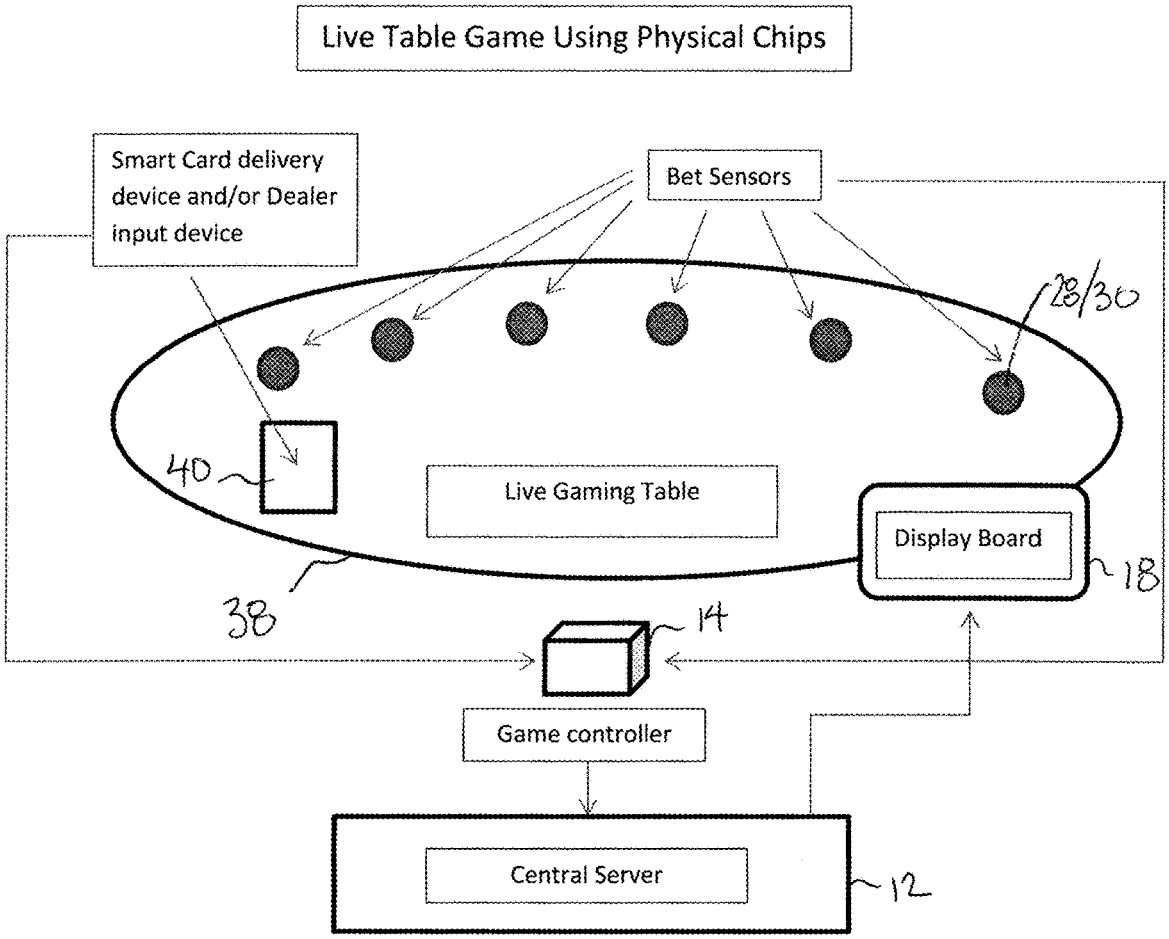
FIG. 3 is a schematic representation of the gaming system according to a live table game embodiment.

In the instance of a live table game using physical chips placed by players on the table 38 for placing a wager, the system may take the form presented in FIG. 3. In this instance, the player input device comprises suitable technological elements for assessing wagers by the player, for example Bet Sensors, which provide the function of the player input device 28 and the credit acceptor 30 of the system shown in FIG. 1. The bet sensors may also be equipped with card sensors for reading individual cards of the player to determine the outcomes of the wagers. Additional input may be provided by a dealer card sensor or input device 40. Alternatively, the input device 40 may take the form of a smart card delivery device which is capable of identifying each card as it is dealt to either the players or the dealer for tracking the order of play of the game. In either instance, the gaming software tracks the order of play to determine when auxiliary amounts are determined to be payable to the player. The gaming display 18 in this instance may comprise individual display terminals associated with each player position at a card table, or a common display that several players can view simultaneously to indicate winning amounts. The inputs relating to wagers and player/dealer cards are all directed to the main processor or game controller 14 of the central server 12 which executes the gaming software to control the overall function of the game according to the gaming software. The crediting of winning amounts to players in this instance may take the form of an instruction directed to the main display board 18 or to a dealer display which instructs the dealer to credit the player with physical chips dispensed onto the game table surface.

In the instance of electronic betting terminals, the terminals directly receive player input 28 through the terminal 20 and display information directly to the associated player through the terminal display 26. In this instance, the card game may be played as a virtual game entirely executed on the gaming server or as a hybrid gaming system including a live dealer in which player terminals are provided to execute game play for individual players using card data generated by the live dealer cards.

Game Play

According to the first aspect of the present invention, the base game is dealt in accordance to standard baccarat rules, which dictate how the cards are drawn and the hands values are totaled. The difference between a standard baccarat game rules and 99 Mysteries Baccarat is how winning and losing hands are determined.

Banker Hand

The Banker hand wins a payoff of 1 to 1 when, in accordance with standard baccarat rules, the Banker hand total is higher than the Player hand. Additionally, a wager on the Banker hand wins a payoff of 2 to 1 if the rounds results in a Tie of 9 where both the Player hand and the Banker hand each consist of three cards. The Banker hand loses when the Player hand has a higher hand total or if there is a Tie outcome where both hands are not totals of 9 and each hand consist of three cards. The Banker hand pushes on all remaining outcomes.

Player Hand

The Player hand wins a payoff of 1 to 1 when, in accordance with standard baccarat rules, the Player hand total is higher than the Banker hand. Additionally, a wager on the Player hand wins a payoff of 6 to 1 if the rounds results in a Tie of 8 or 9 where both the Player hand and the Banker hand each consist of three cards. The Player hand loses when the Banker hand has a higher hand total or if there is a Tie outcome where both hands are not totals of 8 or 9 and each hand consist of three cards. The Player hand pushes on all remaining outcomes.

Alternate Returns for Banker Three Card Ties of 9 & Player Three Card Tie 8 or 9

Figures 4, 5, 6:
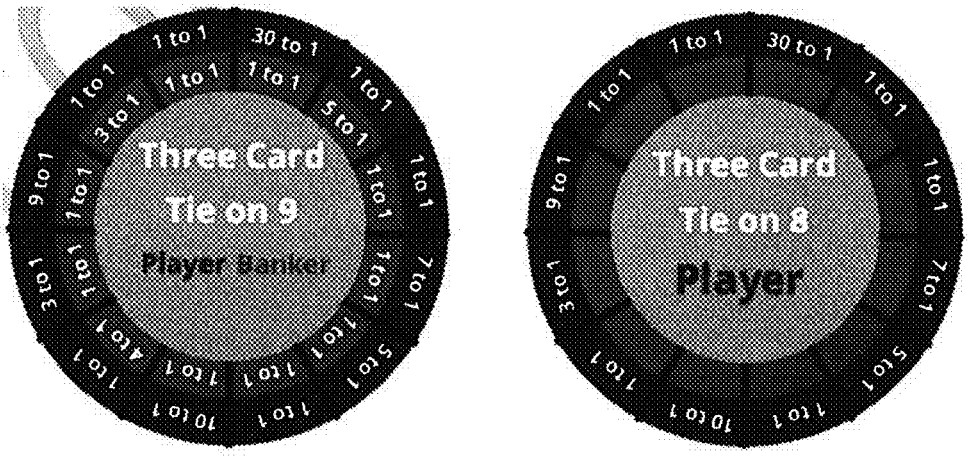
FIG. 4 is a table representing odds for different pay out amounts according to prescribed winning criteria.
FIG. 5 is another table representing odds for different pay out amounts according to additional prescribed winning criteria.
FIG. 6 is a schematic representation different virtual spinning wheels which can be used to visually represent the prescribed winning criteria according to the tables of FIGS. 4 and 5.

An alternative to paying fixed odds for the 3-card Tie outcomes, a virtual wheel can be used with 12 stops where the 'Mystery" wheels are configured as shown in FIG. 4.

Rather than paying 2 to 1 for a Banker wager when the hand totals results in a Tie of 9 and where both the Player hand and the Banker hand each consist of three cards, a virtual wheel can be used with 12 equally probable stops where the wheel is configured as shown in FIG. 5. Such virtual wheels may look as depicted in FIG. 6.

Tie

The Tie bet wins as it normally does under standard baccarat rules.

Three Card Tie

This is a new wagering option that has a payoff of 99 to 1 when the round results in a Tie of 9 where both the Player hand and the Banker hand each consist of three cards. The bet also has a payoff of 19 to 1 if there is a Tie outcome where both hands are not totals of 9 and each hand consist of three cards. All other outcomes lose.

In this instance, the gaming software stored on the gaming server defines game rules of a wagering game which includes betting options defining base game criteria relating to the conventional Baccarat game and as well auxiliary game criteria which differs from the conventional Baccarat game. Each of the base game criteria relates to an identified winning condition according to the conventional baccarat game rules and includes a corresponding winning amount associated therewith. The auxiliary game criteria, for example three card ties as described above, define auxiliary winning conditions. Once a winning hand has been determined, according to one of the winning conditions, one of a plurality of different winning amounts associated with that winning condition is then paid out to the player. The different winning amounts correspond to different payout ratios relative to the wager amount. Each of the different payout ratios includes a different probability value associated therewith. Using the probability values and the random number generator, the gaming software selects which one of the winning amounts associated with each winning condition is used to determine the amount credited to the player for winning.

Mystery Jackpot

Incrementing Jackpot Meters

Turning now to a further aspect of the present invention, there is provided a progressive game for use in conjunction with a base game which is referred to herein as the Mystery Jackpot feature. This feature is described herein in relation to the game of baccarat, but may also be applied to other games. Ideally each available wager contributes to the jackpot(s), which may be anywhere from a single incrementing jackpot to a multitude of incrementing jackpots.

There are at least five ways that these jackpots can be contributed to:

1. A fixed portion of each dollar wagered will be allocated to the jackpot(s), with each available jackpot receiving a portion of the fixed amount.

2. A fixed portion of each losing dollar wagered will be allocated to the jackpot(s), with each available jackpot receiving a portion of the fixed amount.

3. A fixed portion of each winning dollar wagered will be allocated to the jackpot(s), with each available jackpot receiving a portion of the fixed amount.

4. A fixed portion of each dollar wagered on a designated hand(s) outcome will be allocated to the jackpot(s), with each available jackpot receiving a portion of the fixed amount.

5. A random portion of each dollar wagered based on the above criteria will be allocated to the jackpot(s), with each available jackpot receiving a portion of the random amount.

For the above, a "fixed portion" means one or both of a percentage of the wager or a fixed dollar amount of the wager.

Each jackpot will begin with a designated amount and increment to a maximum of a second, higher designated amount.

Determining a Winning Jackpot

Each jackpot has designated a winning value between the beginning amount and the maximum amount. The player wins if a bet they place increments the jackpot equal to or more than the designated winning value, which is unknown to the player. This triggers the affected jackpot to revert to the beginning amount and the player is paid the value of the designated winning value.

There are at least two ways of determining the designated winning value(s):

1. A static value between the beginning amount and the maximum amount is determined via an RNG (random number generator or any mechanism that creates a measurable random outcome) and remains that amount until won.

2. A dynamic value that changes between plays or at prescribed intervals, where an RNG determines the winning value between the current jackpot value and the maximum winning amount.

Additional Features

1. A betting position is comprised of a plurality of betting options, each having a unique house edge. Example: A betting position on baccarat game can be comprised of betting options such as a Player Bet, Banker Bet, Tie Bet, Pair Bet, etc.

Jackpot Growth

2. A unique portion of each wager made on each betting option from a betting position during a round of play is then allocated to an amalgamated position pool.

3. The position pool is then distributed to a plurality of jackpots, where each jackpot is assigned a part of the position pool such that the sum of the parts assigned equal 100% of the position pool.

4. A multitude of betting positions will likewise contribute to the same plurality of jackpots, which will result in each jackpot incrementing after each round of play.

5. Each jackpot will start with a defined dollar value and will increment higher until won.

Betting Position Points

6. Each betting position will accumulate points after each round of play in a plurality of accounts where each account is associated with one of the said plurality of jackpots.

7. For each betting position, the amount of points assigned to each account will be an amount proportional to the distribution of the position pool (See 3) factored by the probability of a trigger event (to clarify, not a "point trigger").

8. The assigned points to each account will accumulate after each round of play until the associated jackpot is won.

9. Each assigned point to the accounts of the multitude of betting positions will be a unique integer for each specific jackpot, such that no account will have the same point as any in another betting position's account assigned to the same jackpot.

Assigning Point Triggers

10. A RNG (random number generator) will produce at least one number from each of a plurality of number sets where each number set corresponds to the plurality of jackpots.

11. Each number set will consist of an integer range that is equal to or greater than the range of integers assigned to each betting position (6-9).

Trigger Event

12. A trigger event is one or more designated outcomes produced by a physical gambling device, such as cards, dice and wheels.

Winning a Jackpot

13. A jackpot is won if both the unique position point integer matches a point trigger for the associated jackpot and the trigger event occurs during the round.

14. In such a case, the jackpot will revert to the starting dollar amount and all assigned position points will be cleared for that jackpot.

Pending Jackpot

15. Each jackpot has designated an "Increment value" between the beginning amount and the maximum amount. The betting spot is designated to win the jackpot if a bet placed increments the jackpot equal to, or more than, the designated Increment value, which is unknown to the player. This triggers an alert to the players on all tables/ETGs that the jackpot is won. However, the players will not know which spot/ETG has won the jackpot until a "Trigger Event" occurs.

Trigger Event

16. A "Trigger Event" is the occurrence of a designated outcome produced by a physical gaming object (Dice, wheel, etc.), which in this case would be a baccarat card outcome. The players must now wager until the Trigger Event occurs in order to determine who has won the pending jackpot. The jackpot will continue to increment until such time. Once the jackpot is won, the jackpot will to revert to the beginning amount. The Trigger Event can be high frequency, such as a Tie, or low frequency, such as a 6-Card Tie of 9. As the players are now incentivized to play until the jackpot is resolved, the lower the frequency of the Trigger Event, the more additional play will be realized until the Trigger Event occurs.

Figure 2:
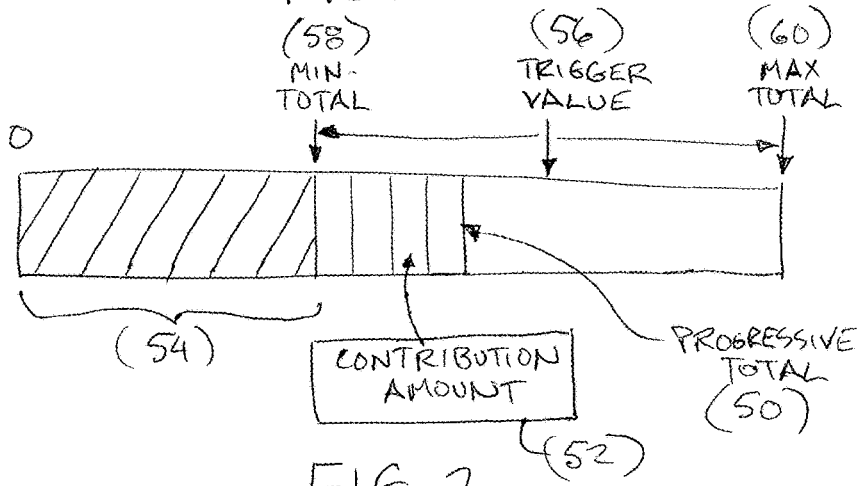
FIG. 2 is a schematic representation of one of the progressive games according to some embodiments of the present invention.

According to the progressive game described herein, the gaming software stored on the gaming system includes several data points associated with each progressive jackpot/progressive game of the system. As shown in FIG. 2, each progressive jackpot game includes a progressive total that corresponds to the dollar amount to be paid to a player as a credit when it is determined that the player has won the jackpot. The progressive total 50 has a progressive value which increases by adding on contribution amounts 52 to the current total as gameplay progresses. Each time the progressive total is won by a player and the total amount is paid out, a new value is stored for the progressive total which corresponds to a base amount 54. In this instance, even if the progressive total is won by a second player immediately following the winning by a first player, the second player is guaranteed to win a total corresponding to at least the base amount.

In the instance of a single progressive game, winning of the progressive total is determined simply by the progressive total meeting or exceeding a trigger value 56. The trigger value 56 is a value generated by the random number generator of the central server to be between a minimum total value 58 corresponding to the base amount 54 and a maximum total value 60 corresponding to the maximum jackpot amount to be paid to players by the progressive game.

In the instance of numerous progressive games, winning of the progressive total amount for each progressive game may be determined by the combination of the progressive total meeting or exceeding the associated trigger value 56, together with an eligibility criterion being met which is defined herein as a trigger event. The trigger event may be for instance a particular sequence of cards or a different condition to be met throughout the normal play of the base game with which the progressive game is associated.

Upon determination of any progressive game meeting the winning criteria, and paying of the corresponding progressive total to the player, the trigger value 56 is replaced with a new value generated by the random number generator to be between the minimum and maximum totals. The progressive total 50 is also reset to the minimum total 58 corresponding to the base amount 54. With each subsequent round of play and each subsequent wager placed by the player according to the base game rules, a corresponding contribution amount is added on to the progressive total.

In the instance of numerous progressive games associated with a single base game, the contribution amount, which may be a fixed portion or random portion of each dollar wagered on each wagering option or only on specific wagering options, is distributed in full across the progressive totals of all progressive games respectively. The portion of the contribution amount which is added onto each progressive total is proportional to the probability of the eligibility criteria or trigger event associated with that progressive total being met.

As described herein the gaming system of FIG. 1 executes gameplay by following programming instructions stored on the memories of the central server and the player terminal memories. The programming instructions include instructions relating to base rules of a base game as well as game rules relating to one or more progressive games stored on the central server. The base games are typically executed on individual player terminals independently of one another. Each base game operating on a respective player terminal executes a round of play by receiving a wager from a player through the terminal input device of the respective player terminal in response to gaming information displayed on the display of the terminal. The wager is placed on a betting position of the base game and resolved according to the rules of the base game on the player terminal. In response to each round of play of a base game on a respective player terminal, a contribution amount based on the base wagers as described above is contributed to the progressive total of one or more progressive games operating on the central server.

Alternatively, on a live table according to FIG. 3, player input devices can be used to allow individual players to place base game wagers for resolving the base game wagers independently of one another in place of player terminals. In this instance, the central gaming server functions as a server with memory and processor for the progressive game and as a server with processor and memory for the base game wagers placed by respective players being resolved independently of one another.

Each progressive game stored on the central server includes a respective progressive total which can be varied between a minimum total and a maximum total as illustrated in FIG. 2 and described above. A trigger value between the minimum and maximum total values is determined by a random number generator and remains constant until the progressive total is won by one of the player terminals. As individual base games are operated on each of the player terminals, all of the player terminals contribute contribution amounts based on the respective wagers made within the base games so that all contribution amounts are distributed according to the same guidelines and progressive game rules to the progressive totals of all progressive games on the central server. Each progressive game also has eligibility criteria associated therewith. Examples of eligibility criteria include a prescribed result within a round of play of the base game such as specific playing cards being assigned to either one of the player or the banker, or a specific winning condition having been met by the player, or even a specific losing condition in some instances.

When the round of play on one player terminal results in a contribution amount which is added to the progressive total of one of the progressive games resulting in the progressive total meeting or exceeding the trigger value of that progressive game, then a winning state is determined for that player terminal only in relation to the progressive total corresponding to that progressive game. If the eligibility criterium is not also met however that player terminal remains in a winning state in relation to that prescribed game for another round of play in which comparison to the eligibility criteria is again made. Further rounds of play continue so that contribution amounts continue to increase the progressive total with each round of play by contribution amounts from that player terminal and from all other player terminals where rounds of play continue until the eligibility criteria for that progressive game is met on the player terminal with which the winning state is associated.

Once a winning state has been determined in relation to one of the progressive games by a contribution amount from one of the player terminals/input devices, the gaming server provides a notification to all player terminals/input devices through the terminal displays or through the main display of the central server that one of the progressive games is in a winning state; however, the identity of the player terminal/input device with which the winning state is associated is withheld and kept confidential by the system.

As players continue to play ongoing rounds of play of the base game on the respective player terminals, the other progressive, games remain in a non-winning state with the contribution amounts continuing to increase the value of the progressive totals of the other progressive games in the usual manner. Similarly, to the determination of a winning state as noted above, if a second progressive game has a progressive total which meets or exceeds the trigger value thereof as a result of a contribution amount from the same or from another player terminal, the player terminal from which that contribution amount originated is similarly placed in a winning state in association with that progressive game.

Once the eligibility criteria has been met by a terminal in a winning state, the player associated with that player terminal is credited a winning amount corresponding to the current value of the progressive total that resulted in determination of the winning state. For all progressive games, the winning amount can only be credited to the player terminal from which originated the contribution amount that resulted in determination of the winning state. Once the eligibility criterium has been met for a terminal in a winning state, subsequent to crediting a corresponding winning amount to the player on that player terminal, the trigger value associated with the winning state is reset to a new value between the minimum and maximum totals using a random number generator. The random number generator may be part of the programming instructions stored on the central server.

When using additional eligibility criteria before paying out a winning amount, progressive jackpots are effectively paid out using a double trigger. The progressive total reaching the trigger value is the first trigger which puts the jackpot in a pending winning mode, but none of the players on the player terminals/input devices know which terminal has won until a specific hand has been dealt according to the eligibility criteria that functions as the second trigger.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A gaming system for playing a wagering game, the system comprising:

a gaming server including a memory storing gaming software thereon, a processor, and a random number generator;

a gaming display associated with the gaming server to display gaming information thereon to a player of the wagering game;

a player input device associated with the gaming server to receive player input from the player of the wagering game in response to gaming information displayed on the gaming display;

the gaming software stored on the memory of the gaming server defining base game rules relating to a base game of the wagering game comprised of a plurality of betting options and progressive game rules relating to a progressive game of the wagering game, the progressive game including a minimum progressive amount, a maximum progressive amount, a trigger value that is between the minimum and maximum progressive amounts, and a progressive total stored in the memory;

the processor of the gaming server being arranged to execute the gaming software thereon in response to the player input received by the player input device to:

(i) identify a base game wager from the player relating to the base game;

(ii) augment the progressive total by a prescribed contribution amount based on the base game wager in response to the base game wager from the player being identified;

(iii) credit the player a winning amount corresponding to the progressive total in response to the progressive total being augmented by the prescribed contribution amount to an amount which meets or exceeds the trigger value;

(iv) in response to crediting the player a winning amount, use the random number generator to generate a new value for the trigger value which is between the minimum and maximum progressive amounts;

(v) in response to crediting the player a winning amount, reset the progressive total;

(vi) store the new value as the trigger value in a manner that the trigger value is not displayed or otherwise known to the player; and (vii) repeat steps (i) through (vi).

2. The gaming system according to claim 1 wherein the processor is arranged to execute the gaming software such that the progressive total is reset to the minimum progressive amount in response to crediting the player the winning amount.

3. The gaming system according to claim 1 further comprising a plurality of player terminals for a plurality of players respectively, each player terminal comprising a gaming display to display gaming information to the respective player and a player input device to receive player input from the player of the wagering game, wherein the processor of the gaming server is arranged to execute the gaming software thereon in response to the player input received by each player input device to augment the progressive total by a prescribed contribution amount based on the base game wager in response to the base game wager being received from each of the player.

4. The gaming system according to claim 1 further comprising a plurality of player terminals for a plurality of players respectively, each player terminal comprising a gaming display to display gaming information to the respective player, a player input device to receive player input from the player of the wagering game, and a progressive game associated with each of the player terminals respectively, wherein the processor of the gaming server is arranged to execute the gaming software thereon in response to the player input received by each player input device to augment only the associated progressive total by a prescribed contribution amount based on the base game wager in response to the base game wager being received from the associated player.

5. The gaming system according to claim 1 wherein the gaming display displays a current value of the progressive total.

6. The gaming system according to claim 1 wherein the prescribed contribution amount is a fixed portion of every winning and losing wager.

7. The gaming system according to claim 1 wherein the prescribed contribution amount is a fixed portion of losing wagers only.

8. The gaming system according to claim 1 wherein the prescribed contribution amount is a fixed portion of winning wagers only.

9. The gaming system according to claim 1 wherein the prescribed contribution amount is a fixed portion of selected ones of the plurality of betting options only.

10. The gaming system according to claim 1 wherein the prescribed contribution amount is a random portion of the wager.

11. The gaming system according to claim 1 wherein the base game rules define a conventional baccarat game.

12. The gaming system according to claim 1 wherein the trigger value remains constant between occasions where the player is credited a winning amount.

13. The gaming system according to claim 1 wherein the trigger value is a dynamic value which is reset in some instances when the progressive total does not meet or exceed to the trigger value.

14. A gaming system for playing a wagering game, the system comprising:

a gaming server including a memory storing gaming software thereon, a processor, and a random number generator;

a gaming display associated with the gaming server to display gaming information thereon to a player of the wagering game;

a player input device associated with the gaming server to receive player input from the player of the wagering game in response to gaming information displayed on the gaming display;

the gaming software stored on the memory of the gaming server defining base game rules relating to a base game of the wagering game comprised of a plurality of betting options and progressive game rules relating to a plurality of progressive games of the wagering game, each progressive game including a minimum progressive amount, a maximum progressive amount, a trigger value that is between the minimum and maximum progressive amounts, a progressive total, and an eligibility criterium stored in the memory;

the processor of the gaming server being arranged to execute the gaming software thereon in response to the player input received by the player input device to:

(i) identify a base game wager from the player relating to the base game;

(ii) augment the progressive total of each progressive game by a prescribed contribution amount based upon the base game wager in response to the base game wager from the player being identified;

(iii) credit the player a winning amount corresponding to the progressive total of one of the progressive games in response to the eligibility criterium of that progressive game being met and the progressive total being augmented by the prescribed contribution amount to an amount which meets or exceeds the trigger value of that progressive game;

(iv) in response to crediting the player a winning amount corresponding to the progressive total of one of the progressive games, use the random number generator to generate a new value for the trigger value for that progressive game which is between the minimum and maximum progressive amounts of that progressive game;

(v) store the new value as the trigger value for that progressive game in a manner that the trigger value is not displayed or otherwise known to the player; and (vi) repeat steps (i) through (v).

15. The gaming system according to claim 14 wherein each trigger value is a unique value which differs from the trigger values of other progressive games.

16. The gaming system according to claim 14 wherein the processor of the gaming server is arranged to execute the gaming software thereon to send an alert through the gaming display when the progressive total has been augmented by the prescribed contribution amount to an amount which meets or exceeds the trigger value of that progressive game, but the eligibility criterium of that progressive game has not yet been met.

17. A gaming system for playing a wagering game, the system comprising:

a gaming server including a memory storing gaming software thereon and a processor;

a gaming display associated with the gaming server to display gaming information thereon to a player of the wagering game;

a plurality of player input devices associated with the gaming server to receive player input from respective players of the wagering game in response to gaming information displayed on the gaming display;

the gaming software stored on the memory of the gaming server defining (i) a random number generator, (ii) base game rules relating to a base game of the wagering game associated with each player input device comprised of a plurality of betting options, and (iii) progressive game rules relating to at least one progressive game of the wagering game, said at least one progressive game including a minimum progressive amount, a maximum progressive amount, a trigger value that is between the minimum and maximum progressive amounts, a progressive total, and an eligibility criterium stored in the memory;

the processor of the gaming server being arranged to execute the gaming software thereon in response to the player input received by the player input device to execute a round of play by:

(i) identifying and resolving a base game wager input from the player on each player input device relating to the base game;

(ii) augmenting the progressive total of said at least one progressive game by a prescribed contribution amount based upon the base game wager on each player input device;

(iii) in response to the progressive total being augmented by the prescribed contribution amount to an amount which meets or exceeds the trigger value of that progressive game, determining that the player input device from which said prescribed contribution amount originated is in a winning state;

(iv) if the eligibility criterium of that progressive game is not met and the player terminal is in the winning state, maintaining that player input device in the winning state for a subsequent round of play;

(v) if eligibility criterium of that progressive game is met and that player input device is in the winning state, credit the player input device a winning amount corresponding to the progressive total of that progressive game and use the random number generator to generate a new value for the trigger value for that progressive game which is between the minimum and maximum progressive amounts of that progressive game and store the new value as the trigger value for that progressive game in a manner that the trigger value is not displayed or otherwise known to the players operating the player input devices; and (vi) repeat steps (i) through (v).

18. The gaming system according to claim 17 wherein the processor of the gaming server is arranged to execute the gaming software thereon such that the winning amount is only credited to the player input device from which originated said prescribed contribution amount that augmented the progressive total to the amount which meets or exceeds the trigger value.

19. The gaming system according to claim 17 wherein the processor of the gaming server is arranged to execute the gaming software thereon such that, in the winning state, the progressive total continues to augment by contribution amounts from all player input devices until the eligibility criterium is met on the player input device from which originated said prescribed contribution amount that augmented the progressive total to the amount which meets or exceeds the trigger value.

20. The gaming system according to claim 17 wherein the processor of the gaming server is arranged to execute the gaming software thereon such that the gaming server provides an indication to all player input devices that one of the player input devices is in the winning state without identifying which of the player input devices is in the winning state in response to determination of the winning state on said one of the player input devices and such that the gaming server continues to provide said indication until the eligibility criterium is met on the player input device from which originated said prescribed contribution amount that augmented the progressive total to the amount which meets or exceeds the trigger value.

* * * * *